US009192040B2

(12) United States Patent
Ehlbeck et al.

(10) Patent No.: US 9,192,040 B2
(45) Date of Patent: Nov. 17, 2015

(54) DEVICE AND METHOD FOR GENERATING AN ELECTRICAL DISCHARGE IN HOLLOW BODIES

(75) Inventors: Joerg Ehlbeck, Hinrichshagen (DE); Klaus-Dieter Weltmann, Binz (DE); Manfred Stieber, Greifswald (DE); Joern Winter, Greifswald (DE); Kim Winterweber, Berlin (DE)

(73) Assignees: Leibniz-Institut fuer Plasmaforschung und Technologie E.V., INP Greifswald, Greifswald (DE); Xion GmbH, Berlin (DE)

( * ) Notice: Subject to any disclaimer, the term of this patent is extended or adjusted under 35 U.S.C. 154(b) by 386 days.

(21) Appl. No.: 13/574,837

(22) PCT Filed: Jan. 26, 2011

(86) PCT No.: PCT/EP2011/051035

§ 371 (c)(1),
(2), (4) Date: Oct. 15, 2012

(87) PCT Pub. No.: WO2011/092186

PCT Pub. Date: Aug. 4, 2011

(65) Prior Publication Data

US 2013/0053760 A1 Feb. 28, 2013

(30) Foreign Application Priority Data

Jan. 26, 2010 (EP) ..... PCTEP2010/050865
Mar. 22, 2010 (DE) ..... 10 2010 003 131

(51) Int. Cl.
*H05H 1/48* (2006.01)
*H05H 1/24* (2006.01)

(52) U.S. Cl.
CPC ..... *H05H 1/24* (2013.01); *H05H 2245/122* (2013.01)

(58) Field of Classification Search
CPC ... H05H 1/24; H05H 2245/122; B01J 19/123; B01J 19/126; B01J 19/088; B01J 2219/0894; B01D 53/32; F01N 3/0892
USPC ..... 422/186.04
See application file for complete search history.

(56) References Cited

U.S. PATENT DOCUMENTS 3,070,132 A 12/1962 Sheridan
3,081,250 A 3/1963 Hall et al.

(Continued)

FOREIGN PATENT DOCUMENTS

EP 1 933 605 A1 6/2008
EP 2 052 743 A1 4/2009
WO WO 2008/005829 A2 1/2008

OTHER PUBLICATIONS

International Search Report issued Jun. 27, 2011 in Application No. PCT/EP2011/051035.
M. Laroussi, et al., "Room-temperature atmospheric pressure plasma plume for biomedical applications", Applied Physics Letters, vol. 87, No. 11, 2005, pp. 113902-1 to 113902-3.

(Continued)

*Primary Examiner* — Xiuyu Tai
(74) *Attorney, Agent, or Firm* — Laurence A. Greenberg; Werner H. Stemer; Ralph E. Locher

(57) ABSTRACT

A device and method for generating a physical plasma in hoses of long and simultaneously constricted lumen, flexible or rigid dielectric hoses, tubes or other hollow bodies in the low, normal or overpressure range, which are partially or completely filled or flushed by process medium of gas or gas mixtures, one or more liquids, liquids including gas bubbles, liquid-gas mixtures, aerosols and/or foam, for purposes of cleaning, activating, coating, modifying and biologically decontaminating, disinfecting, sterilizing the inner walls of the hoses or the process medium itself. The device includes a high voltage supply and a process medium supply, at least one electrically conductive grounded electrode and at least one electrically conductive high voltage electrode, both embedded in the wall of the hose.

17 Claims, 9 Drawing Sheets

(56) References Cited

U.S. PATENT DOCUMENTS

Figure 1:
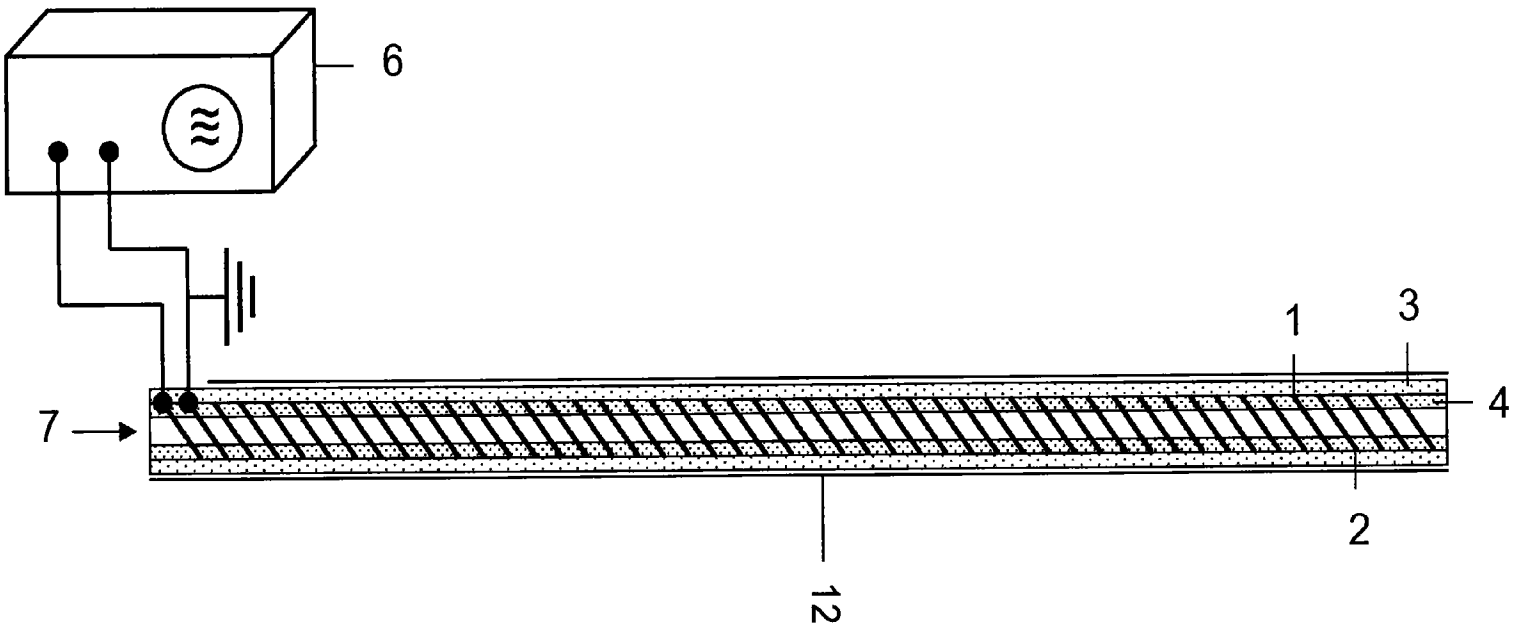

| | | | | |
|---|---|---|---|---|
| 2005/0118079 | A1* | 6/2005 | Muroi et al. | 422/186.3 |
| 2006/0133970 | A1* | 6/2006 | Imanishi et al. | 422/186 |
| 2010/0065415 | A1 | 3/2010 | Sato | |
| 2010/0310735 | A1 | 12/2010 | Rasmussen et al. | |

OTHER PUBLICATIONS

Hiroyuki Eto, et al., "Low-Temperature Internal Sterilization of Medical Plastic Tubes Using a Linear Dielectric Barrier Discharge", Plasma Processes and Polymers, vol. 5, 2008, pp. 269-274.

* cited by examiner

DEVICE AND METHOD FOR GENERATING AN ELECTRICAL DISCHARGE IN HOLLOW BODIES

The invention relates to a device and a method for uniformly generating a physical plasma in long and simultaneously narrow lumens, flexible or rigid dielectric tubes, pipes or other hollow bodies (referred to hereinafter as tubes) in the low, normal or overpressure range, which are filled or flushed partly or completely with gas or gas mixtures, one or more liquids, liquids containing gas bubbles, liquid-gas mixtures, aerosols and/or foam (referred to hereinafter as process medium), for the purpose of cleaning, activation, coating, modification and biological decontamination (antisepsis, disinfection, sterilization) of the inside walls of these tubes and/or of the process medium itself, as well as for the purpose of therapeutic application by means of a dielectrically hindered barrier discharge or by means of the therapeutic components formed in the process medium by the electrical discharge.

TECHNICAL BACKGROUND

For a large number of applications, especially in the area of biomaterials for medical devices, it is necessary to modify the inside walls of long and simultaneously thin tubes made of a dielectric material. Such a process includes cleaning, activation, modification and biological decontamination. Typically these modifications cannot be performed during the production of the materials, while in many fields, and depending on the area of application, the modification must be regularly renewed after the manufacturing process has been carried out. Physical plasmas offer a large number of advantages for this kind of application. The modifications achieved are distributed homogeneously over the surface, are very thin (nm range), are strongly adhering and alter the composition and properties of the basic material only very slightly. The different modifications may be achieved by suitable choice of the process medium and of the physical parameters of the plasma. For cost reasons, and for simple integration into existing process steps, the modifications by a physical plasma should take place as far as possible under normal pressure. Heretofore, however, it has proved to be extremely difficult to generate, under normal pressure, a plasma that is homogeneous over the entire length of the tube for a highly variable range of parameters and large aspect ratio of the tubes. Especially for complex medical devices, such as endoscopes, for example, it is difficult to couple electrical fields from outside the endoscope into the interior of the working channels, in order to ignite a physical plasma therewith. From the user's viewpoint, it is also disadvantageous to introduce electrodes into the working channels in order to couple in the power for the plasma, since the surfaces of the channels could be damaged.

PRIOR ART

Devices and methods for generating physical plasmas in the interior of tubes filled with process medium are described in numerous publications. However, the technical solutions cited here suffer from at least one or more of the following disadvantages.

- the device functions only with tubes in the raw condition and not in the structurally integrated condition
- The device needs special internal electrodes
- The device needs special external electrodes
- The device does not function at normal pressure
- The device has high upkeep costs, for example due to high gas flowrates

- The device is confined in the treatment section
- The device is not able to guarantee homogeneous treatment over the length of the tube
- The device is restricted to noble gases, whereby the area of use is limited
- The device is not suitable for processing thermally labile materials
- The biological decontamination is carried out with aggressive media, which entails material damage A method exists in which a long and thin tube is routed through an externally generated field. In this case the field strength is high enough to ignite a physical plasma in the interior of the tube (DE 69502185 T2=EP 0745149 B1). However, this method is usable only for tubes that are not structurally integrated. In commercial endoscopes, for example, this method would not be feasible.

A further method inserts a short needle into the tube, whereby a jet-like plasma is generated. Because of a high gas flowrate, the plasma can then be driven forward by a certain distance in the tube (Phys. Plasma 14, 074502 (2007)). In this method, however, homogeneity of the plasma is not assured over the entire length of the tube. Furthermore, in this case also it is necessary to work with an additional internal electrode.

There is known a method in which the tube is routed into a process chamber, wherein part of the process chamber is under vacuum. Two electrodes outside the tube generate the electric field in the interior for generation of the plasma (EP 0348690 A2). However, vacuum is used in part of this design. Furthermore, the process chamber is suitable only for the treatment of tubes that are not structurally integrated.

A further design is achieved via an internal electrode in the tube and an external electrode underneath the tube (Plasma Process. Polym. 2008, 5, 606-614). The physical plasma is therefore generated only between the electrodes and does not fill the entire volume of the tube. Furthermore, additional electrodes are needed in this design also, thus restricting the use in finished medical devices.

There is known a device for dry biological decontamination of inside walls of pipes and other hollow bodies by means of an atmospheric-pressure plasma generated by a dielectrically hindered barrier discharge in a flowing gas atmosphere, which device comprises a conductive grounded electrode as well as an electrically conductive high-voltage electrode in the wall of the tube, wherein the electrodes run parallel in axial direction (EP 1933605 A1). The disadvantage of this device lies in the parallel, axial arrangement of the electrodes, whereby on the one hand inhomogeneous plasma formation is made to take place inside the hollow body, and on the other hand material-damaging pulling and pushing forces develop at the electrodes in the case of bending of the tube. The last fact in particular makes implementation of the described device impossible in arrangements where preservation of flexibility is absolutely necessary (e.g. endoscope channels).

A device for heating flexible plastic tubes is known (WO 2008/005829 A2). In this case, at least one heating element is embedded helically in a polymer layer. The purpose of the device is to heat gaseous or liquid media inside the tube. The structure illustrated in this connection is not used to generate an electrical discharge.

Furthermore, a method has been developed in which a short cylindrical electrode is introduced into the interior of a tube, while the counter electrode is disposed outside the tube (JP 2002337210). In this design also, additional electrodes are needed inside and outside the tubes, thus making the use impossible in complex medical devices, such as endoscopes.

There exists a method in which a long tube is pushed into the tube to be treated. A head equipped with 2 electrodes for generating a physical plasma is provided at the end of the inserted tube. By rotation and axial displacement of the inserted tube, the inside wall of the tube to be treated can be variably modified (JP 7169406 A). In this design also, something that is cumbersome in the special case is inserted into the tube. Moreover, homogeneous modification of the inside wall of the tubes is assured only by a complicated control system. Furthermore, the point-like effect has too little power per unit area for practical applications.

There is known a method in which 2 annular outer electrodes are positioned at a specified distance from one another around the tube. The jet-like plasma then burns between the two electrodes (JP 62195028 A). This design is also achieved with outer electrodes, which makes application in certain medical devices impossible.

A device is known with which a jet-like plasma can be generated outside a dielectric pipe (Applied Physics Letters 2005, 87, 113902). However, it is not possible with this device to generate plasma in the interior of long tubes. This device is unsuitable for applications that need both plasma-generation methods in one instrument (plasma in the tube and jet-like plasma at the tube outlet).

In one publication, a plasma is ignited in the interior of glass pipes. For this purpose a thin internal electrode is introduced into the pipe. The counter electrode comprises silver foil, which has been attached outside the pipe (Plasma Process. Polym. 2008, 5 269-274). This method also needs an external and internal electrode and therefore is unsuitable for use in complex medical devices.

Furthermore, in one publication a corona afterglow discharge is generated with nitrogen. The afterglow plasma is then passed at high flowrate into the tube, so that a plasma is present over a certain distance in the interior of the tube (Plasma Process. Polym. 2008, 5, 559-568). However, no homogeneous modification can be assured with this design, since the intensity of the afterglow discharge wanes continuously. Furthermore, such high flowrates are uneconomical for technical applications.

A further design is described in Plasma Process. Polym. 2008, 5, 14-25). In this case 2 grounded electrodes are mounted in parallel with one another. The high-voltage electrode, also in the form of a plate, is disposed centrally, equidistant from both. The tube to be modified can be introduced respectively above and below the high-voltage electrode, so that a plasma is ignited inside the tube. This design also is constructed with additional electrodes inside and outside the tube. It is therefore unsuitable for complex medical devices.

A further possibility is shown in WO 2009/050240 A1). In this case, a very rapidly advancing ionization wave is generated at the beginning of the tube by means of high flow velocity and a high-voltage discharge. This wave is passed into the tube, where a plasma ball is formed and propagates along the tube. However, this type of plasma generation has been observed only with helium. The possibility is still open that additional precursors can also be introduced at certain places in the tube, so that further functionalization might be achieved. However, the admixture of other gases leads to more rapid energy loss of the plasma ball, and so homogeneous treatment over the entire length of the tube is no longer assured. Furthermore, in the case of the endoscopes, for example, admixture of gases is possible only at the inlet of the tube. In combination with the greatly reduced range of the plasma ball, homogeneous treatment over the entire endoscope length is not possible in this case.

In one publication, an electrical breakdown in a liquid is investigated. In this case the electrodes have a spacing of up to 1 mm. In this way a kind of arc discharge is ignited that on the one hand has only very small spatial extent and on the other hand represents a high thermal load for the materials at the root points. This design is therefore unsuitable for plasma generation in thermally labile tubes. *Plasma Sources Sci. Technol.* 17 (2008) 024010 (10 pp)

In another publication, streamers are generated in liquids or also in gas bubbles surrounded by liquid, by means of a pin-to-plate arrangement. These streamers develop very high temperatures at the root points and have only very limited spatial extent. Coating or decontamination in the interior of thermally labile and narrow lumens is therefore not possible. *Plasma Sources Sci. Technol.* 17 (2008) 024021 (7 pp)

A further publication shows the generation of a plasma in liquids over a distance of 16 cm, achieved by an alternating current voltage pulsed in the ns range. However, the arrangement was developed specially for decontamination (radical generation) of liquids in the volume. In principle, treatments of surfaces with this design are not possible. *Plasma Sources Sci. Technol.* 16 (2007) 273-280

In another publication, there is illustrated a basic design with which an electrical discharge can be generated in principle in a gas bubble and investigated for scientific purposes. However, this design is unsuitable for plasma modification and decontamination of materials in liquids. *J. Phys. D: Appl. Phys.* 41 (2008) 194007 (4 pp)

A further possibility for generating gas plasmas in liquids is shown in *Plasma Sources Sci. Technol.* 17 (2008) 025006 (6 pp). For this purpose an outer electrode is fastened in the form of a helix around a vinyl pipe and a metal rod is introduced as the counter electrode in the center of the pipe. Then water containing argon bubbles is passed through the pipe. A plasma is then ignited in the argon bubbles by application of a suitable high voltage. However, this device operates with an internal electrode, which is not desired in practical use. Furthermore, the argon bubble does not fill the entire diameter of the pipe, and so uniform treatment of the surface is not possible.

There is known a device for generating plane pressure waves in pipes filled with liquid by means of plasma for the purpose of cleaning (DE 2325517). However, the plasma is used exclusively for generating pressure waves in this case, and so liquids themselves cannot be decontaminated by means of plasma using the described device. Furthermore, the device does not ensure plasma formation over the entire tube length.

A known method for treating liquids by means of an electrical gas discharge is described in German Patent DE 4440813 C2. Cleaning of the liquid takes place in a vessel partly filled with liquid under atmospheric pressure by generation of a dielectrically hindered gas discharge in the form of microplasmas in the gas space between electrode and liquid. Generation of a dielectrically hindered barrier discharge in long narrow hollow bodies completely filled with liquid, liquid-gas mixtures, aerosols or foam is not subject matter of the described method. Nevertheless, it is expedient, for example, for cleaning narrow long lumens. In addition, the indicated method does not mention claims for cleaning, activation, coating, modification and biological decontamination (antisepsis, disinfection, sterilization) of the inside walls of tubes.

German Patent DE 60103997 T2 (EP 1276697 B1) relates to a method for fixing a first fluid in a second fluid using a corona discharge generated by means of very high direct current voltages in the range of 50 kV.

There exists a device for cleaning, activation, coating, modification and biological decontamination (antisepsis, disinfection, sterilization) of surfaces by means of a dielectrically hindered surface discharge (WO 2009/019156 A2). However, this device uses an electrode to generate the plasma in the narrow lumen of an internal electrode, and so is disadvantageous for practical use.

A further device operates with a large plasma chamber, on the wall of which there is applied a liquid film, which is then treated with plasma by means of an arc discharge. High power is needed to ignite this arc discharge, and so the arc simultaneously develops a very high temperature. This form of discharge is ruled out for the treatment of thermally labile products. Furthermore, the structure of the device is unsuitable for the aforesaid purpose.

OBJECT OF THE INVENTION

The object of the present invention is to overcome the disadvantages of the technical solutions described hereinabove.

ACHIEVEMENT OF THE OBJECT

The object was achieved according to the features of the claims. According to the invention, the structure of the tubes was changed to the effect that additional electrodes are no longer needed outside or inside the tubes in order to generate a physical plasma that is homogeneous over the entire length of the tubes, without causing changes of the physical, chemical or mechanical properties or of the functionality of the tubes. The device represents in particular a simple and inexpensive change of the structure of such tubes. At the same time, only minor changes are made for finished medical devices containing such tubes. Furthermore, the invention ensures the simplest possible generation of physical plasmas in the tubes of complex medical devices, and so dismantling of the instruments or other special devices are not needed.

DESCRIPTION OF THE INVENTION

The tube walls are provided with several metal conductors (referred to hereinafter as electrodes) wound helically and preferably equidistantly from one another around the tube, the electrodes being disposed inside the tube wall. Typically the electrodes are wound for this purpose on an internal tube and fixed with special adhesives, after which an outer tube is shrunk onto them. Further possibilities consist in embedding the electrodes in a single tube or in applying electrical conductors by special etching or coating processes. The tubes produced in this way can have an inside diameter of several cm down to 1 mm and smaller and a length of several meters. It is absolutely necessary that the material of the electrodes be electrically conductive, while the material of the inner and outer tube must exhibit dielectric properties and preferably have a thickness of 10 μm to 5 mm. According to the invention, these electrodes may have the form of wire with a diameter of preferably 10 μm to 2 mm. Other cross-sectional geometries are likewise usable (e.g. rectangular wire cross sections with a thickness of typically 10 μm to 500 μm and a width of preferably 0.1 to 2 mm). The spacing of the electrodes and the insulating material disposed between them must be chosen such that the resulting field strength between the electrodes upon application of a high voltage is smaller than the dielectric breakdown strength of the insulating material. The number of electrodes is larger than or equal to 2, but every 2nd electrode preferably lies at the same potential. Neighboring electrodes are separately activated, so that one of the electrodes lies at ground potential and the neighboring electrode is activated with an alternating current voltage preferably in the kHz range. According to the invention, an electric field is produced between the electrodes in this design, and it generates a physical plasma when the ignition field strength is exceeded. Thus various discharge modes can be achieved by the electrode spacing and the working gas used as well as by the activation used for the electrodes. Thus volume and surface discharges as well as filamentary and diffuse discharge modes can be adjusted depending on the intended task.

In a further embodiment, the electrodes are disposed in the tubing wall, extending along the axis.

A further embodiment of this device may be achieved via a braiding in the interior of the tube wall. This braiding consists of nonconductive material, which is typically also used in the construction of such tubes, as an example for endoscopes. Electrical conductors extending over the entire length of the tube are then woven continuously and preferably equidistantly into this braiding.

In a further embodiment of the invention, the electrodes are mounted in the tube wall and a wire screen is wrapped in close-fitting manner around the tubing as shown as (12) in FIG. 1. The electrodes in the interior of the wall are energized with alternating current voltage, whereas the screen is at ground potential. In this way a surface discharge is developed in the interior of the tube.

In a further embodiment, the process medium is not introduced in the interior of the tube but is applied externally, whereby a physical plasma can be generated on the outside wall of the tube.

In a further embodiment, dielectric bodies and/or dielectric liquid drops, such as glass beads and/or oil drops, but especially spherical particles with a diameter larger than 100 μm and smaller than the inside diameter of the tube, are introduced into the tube, alone or together with the process medium.

Advantages of the Invention

- The device is very diversely usable; a physical plasma can be generated without problems even in working and jet channels of complex medical instruments, without the need for major modifications to the structure of such instruments or without influence on the function of components of the instrument.
- The function of the tubes remains completely preserved (flexibility, bend radius, etc.), and the strength is even further increased. Depending on construction of the electrodes, external kink protection may be obviated, thus possibly leading to a reduction of the structural size.
- A large number of different process media may be used.
- In addition to physical plasma generation in the interior of the tubes, the device offers the possibility of generating a jet-like plasma at the gas outlet of the tube for cleaning, activating, coating, modification and biological decontamination (antisepsis, disinfection, sterilization) as well as for therapeutic applications.
- Generation of a physical plasma is possible even if the inside walls of the tubes are damp or coated with a liquid film. Plasma drying is also possible at sufficiently high gas flowrates.
- By the addition of dielectric bodies to the process medium, a larger surface area is created inside the tube and thus, for example, increased efficiency of cleaning of the process medium is achieved.

The invention will be explained in more detail hereinafter on the basis of exemplary embodiments, without being limited to these examples.

Exemplary Embodiments

The invention and its possible applications will be explained in detail with the exemplary embodiments illustrated hereinafter in several drawings. The following reference numbers are used for identification of the individual elements of the structure of the device.

| List of reference numbers: | |
|---|---|
| 1 | Grounded electrode |
| 2 | High-voltage electrode |
| 3 | External insulation |
| 4 | Internal tube |
| 5 | Plasma ignited in the process medium |
| 6 | High-voltage source |
| 7 | Process-medium inlet |
| 8 | Shielding |
| 9 | Intermediate insulation |
| 10 | Plastic screen |
| 11 | Dielectric bodies (e.g. gas bubbles, liquid drops, spherical particles) |
| 12 | Wire screen |

The device includes a high-voltage supply, whose frequency ranges from kilohertz to megahertz and which supplies the voltage in the range of 1-25 kV needed for generation of the atmospheric pressure discharge, a dielectric tube, whose diameter can be varied preferably in the range from μm to mm and whose length can be varied from a few centimeters to several meters, and electrically conductive electrodes in the complete tubing wall, which electrodes may be of any desired shape and may have a diameter in the range of μm to several mm.

Explanations of the Drawings

Figure 2:
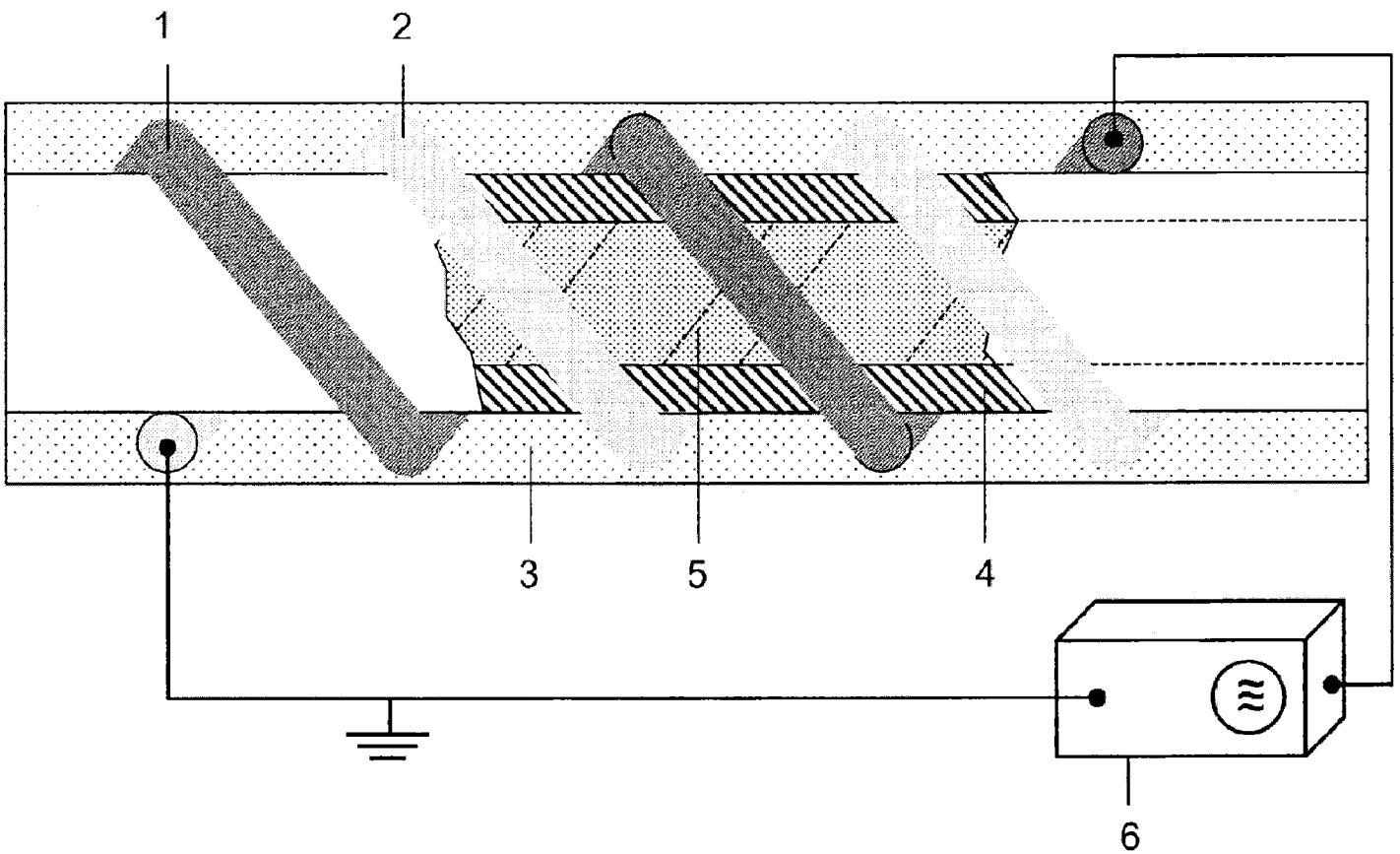
Figure 3:
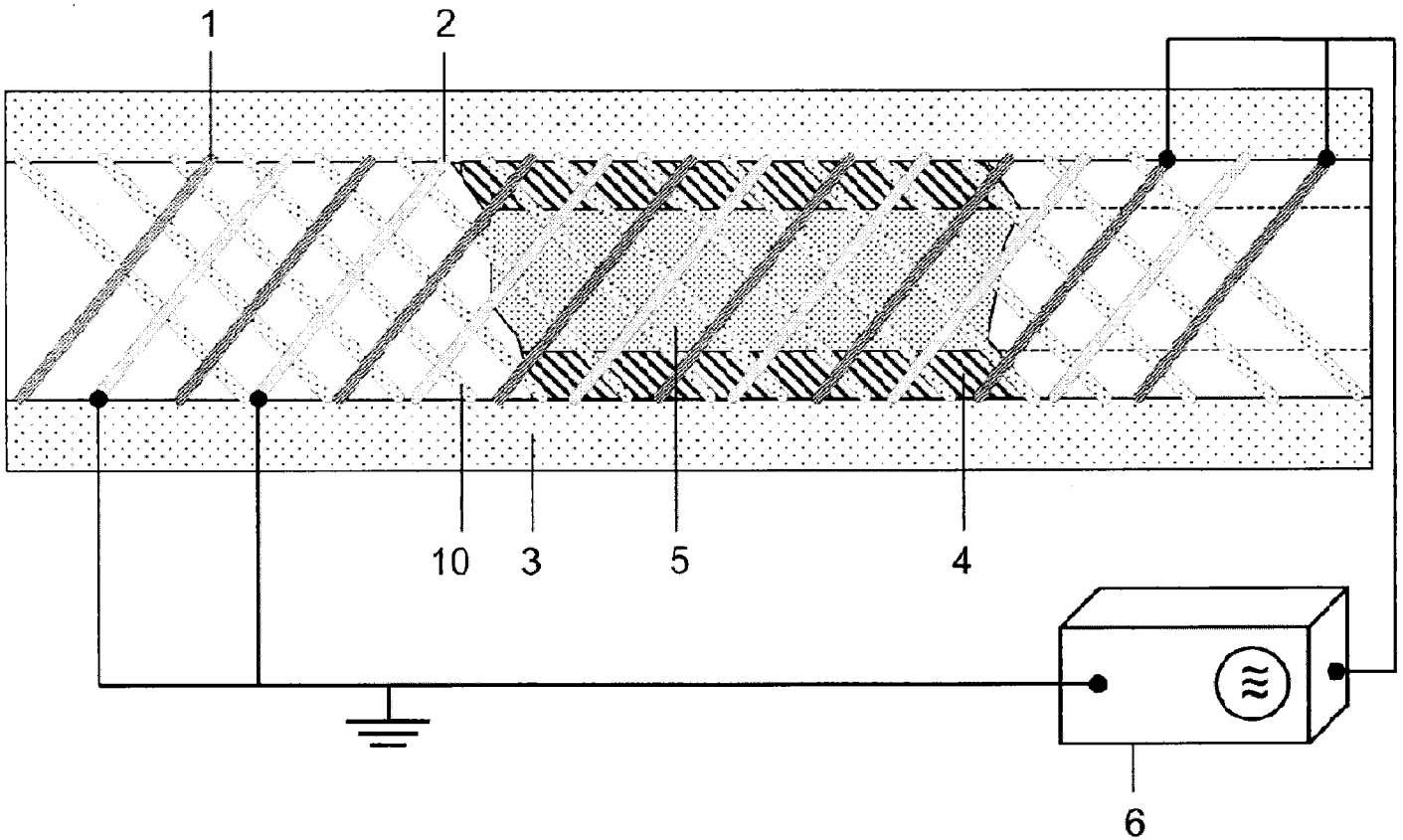
Figure 4:
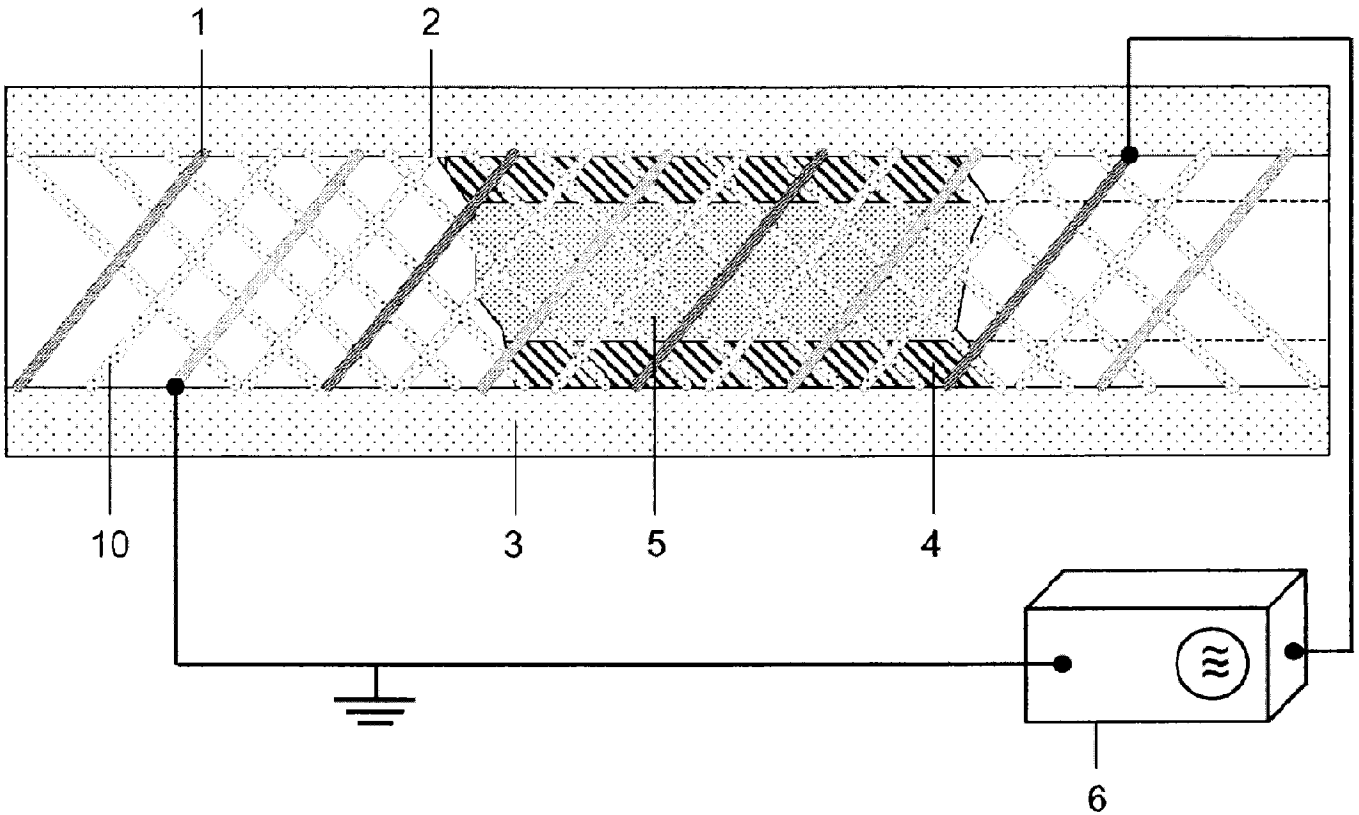
Figure 5:
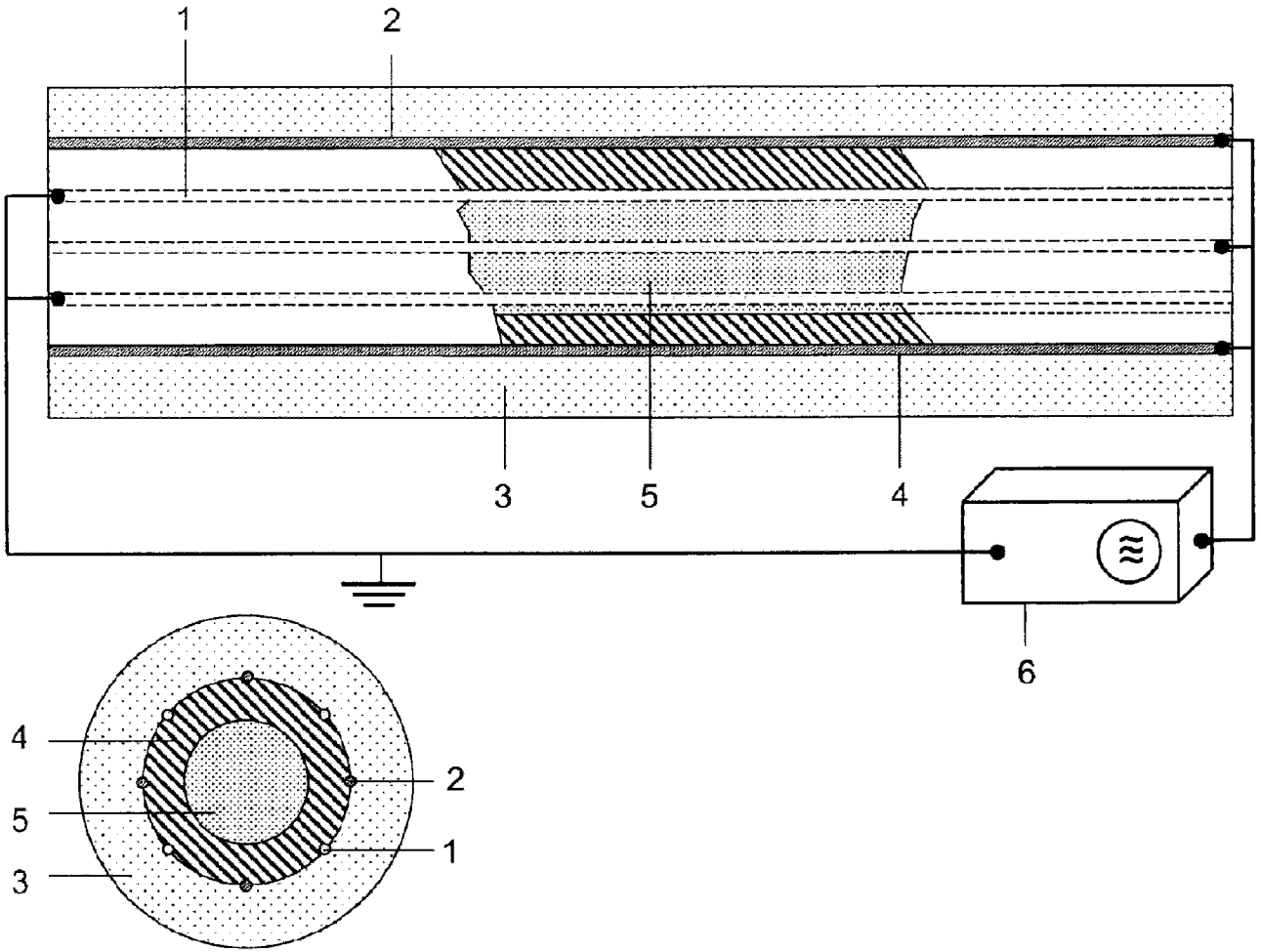

FIG. 1 and FIG. 2 show the basic construction of the device with 2 round electrodes wound helically around the inner tube (4), one (1) being at ground potential and the other (2) at an alternating current voltage. The gas supply (7) is provided via a gas port having a gas nozzle. These electrodes may be present in different arrangements and numbers, as shown in FIGS. 3 and 4, in the form of a net, in which the electrodes are woven into a plastic screen or, as shown in FIG. 5, as parallel wires in axial direction. The number of electrodes is variable. Inner and outer tubes are identical in all arrangements and function as the dielectric.

Figure 6:
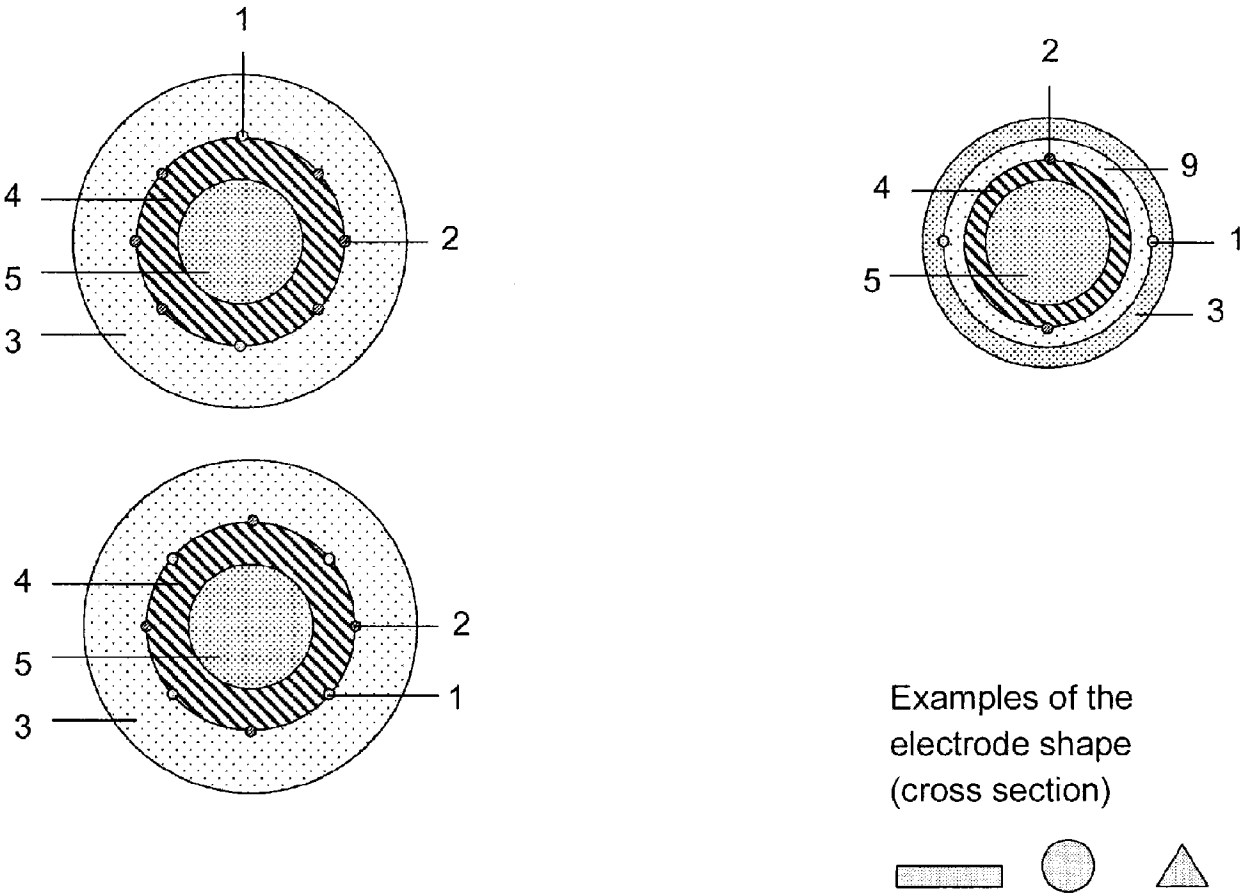

Typical embodiments using more than 2 electrodes are illustrated in FIG. 6.

Figure 7:
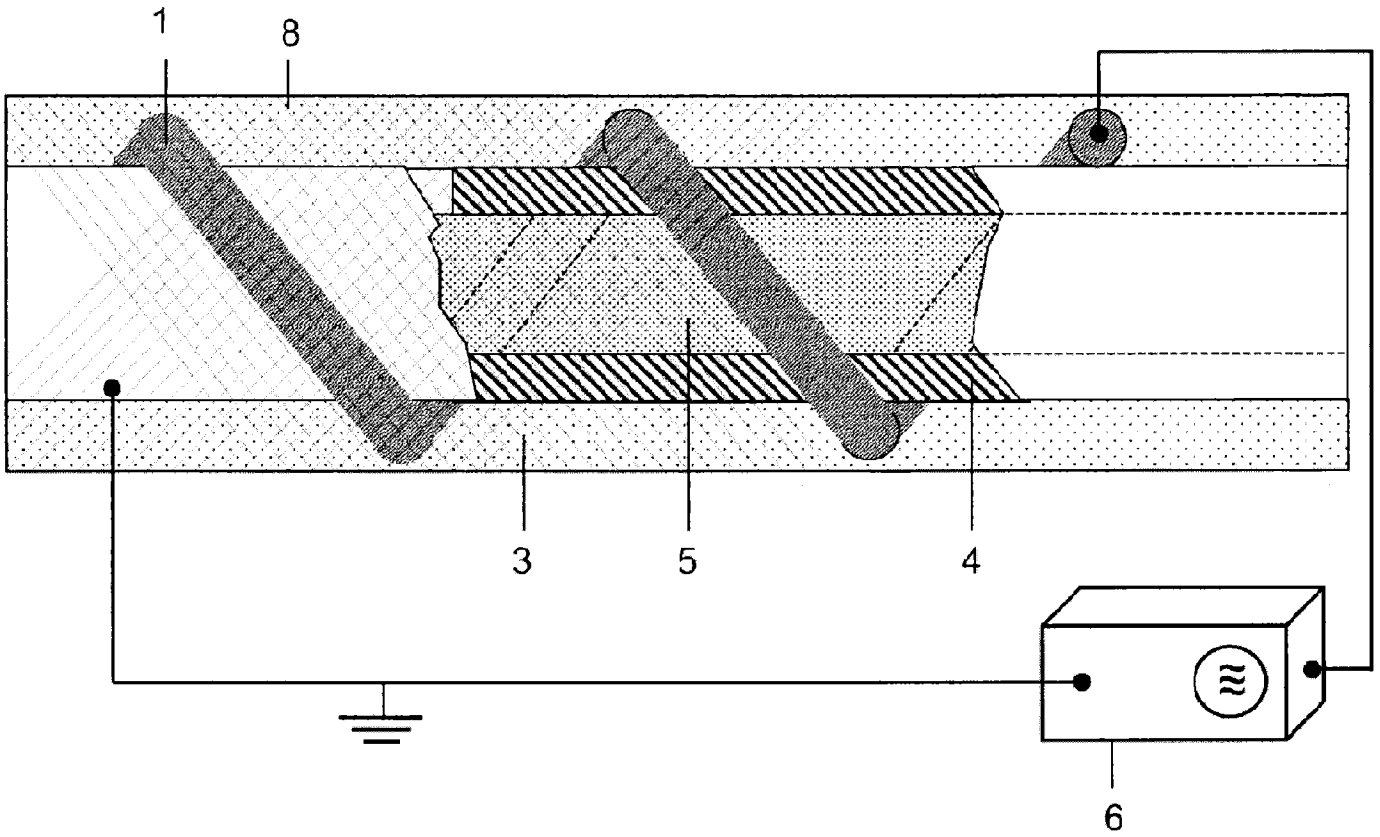
Figure 8:
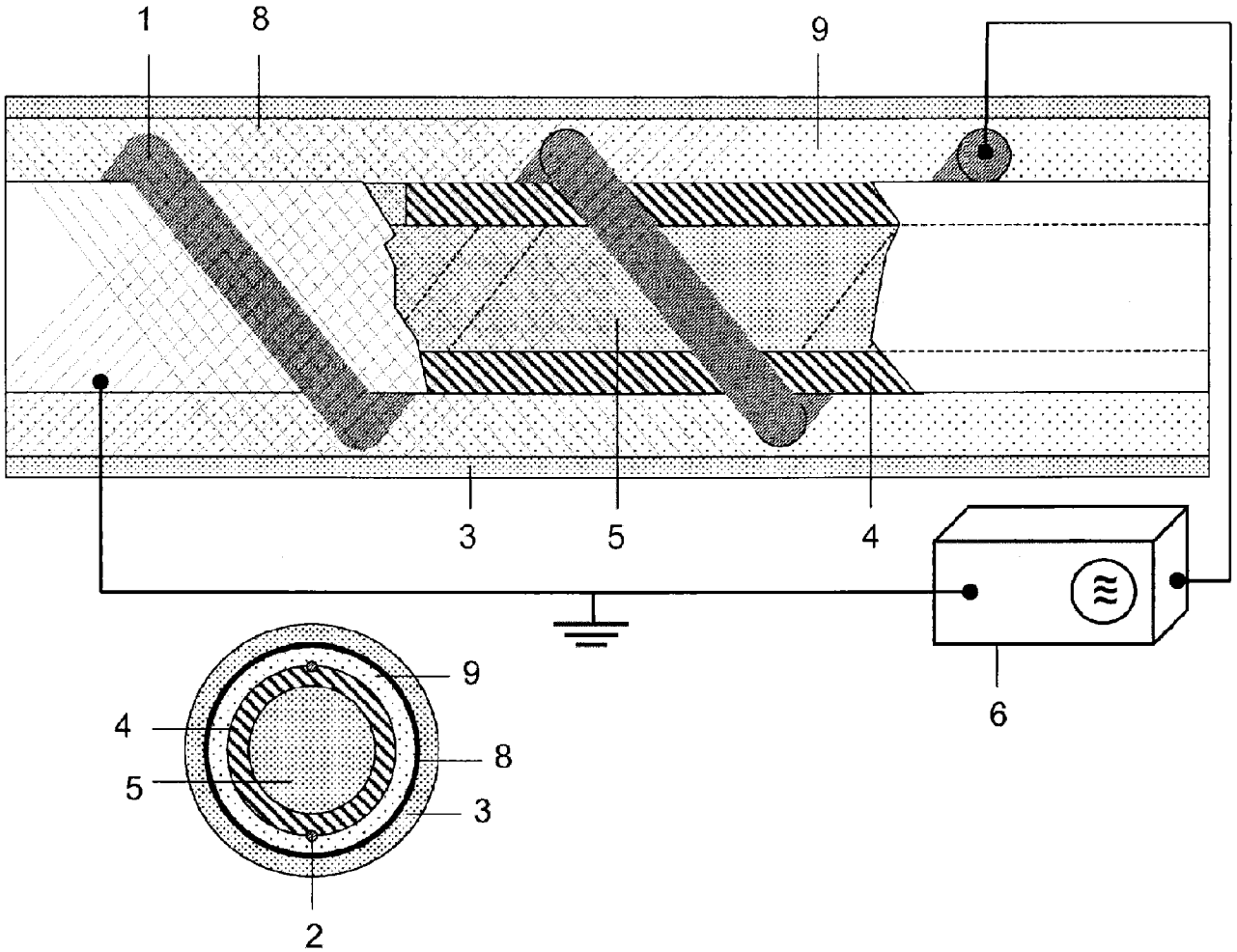

FIG. 7 shows a further embodiment of the tube, in which a grounded electrode in the tube wall was dispensed with, but instead the electrical shielding or anti-kinking reinforcement is used outside the tube as the ground electrode. In this way a surface discharge is developed in the interior of the tube. In FIG. 8, the shielding also is incorporated into the tube wall.

Figure 9:
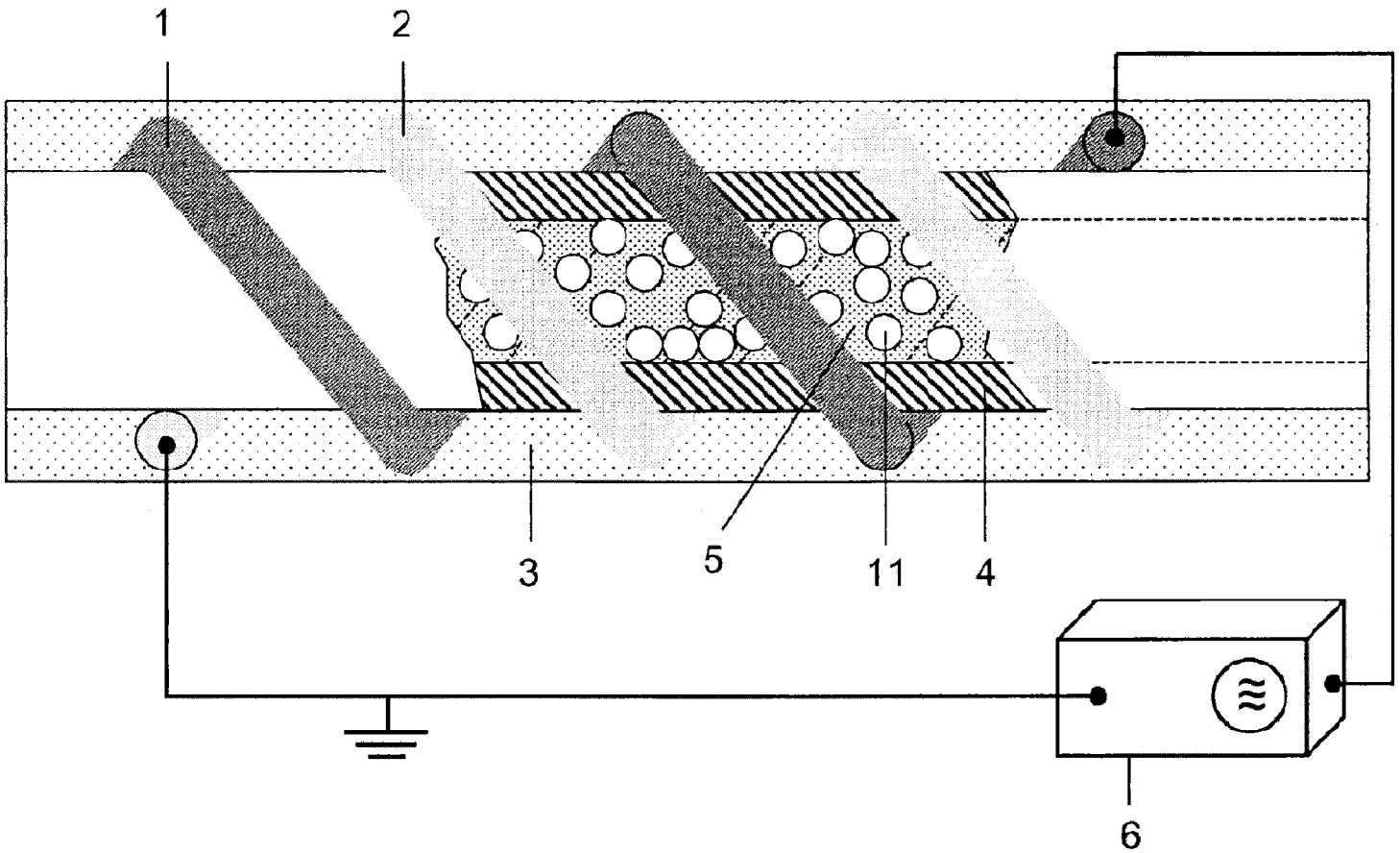

FIG. 9 shows a further embodiment, in which the dielectric bodies and/or dielectric liquid drops, such as glass beads and/or oil drops, but especially spherical particles with a diameter larger than 100 μm and smaller than the inside diameter of the tube, are introduced into the tube, alone or together with the process medium.

In all exemplary embodiments, the high-voltage electrode is activated with a voltage in the kilovolt range and a frequency of a few kilohertz to megahertz, with a sine-wave, rectangular-wave or triangular-wave signal. In this way it is possible to utilize the different pulse duty factors and edge rates of rise, in connection with which special pulse or burst voltages may represent a particular advantage for some processes.

The invention claimed is:

1. A tubular device, comprising:

an internal tube having dielectric properties and having an inner surface and an outer surface;

an external insulation tube enclosing the inner tube;

an electrically conductive electrode wire;

one electrically conductive grounded electrode wire;

a voltage supply; and a process medium inlet;

wherein the electrically conductive electrode wire and electrically conductive grounded electrode wire are spatially arranged on the outer surface of the internal tube and/or embedded in the internal tube, the electrically conductive electrode and electrically conductive grounded electrode are covered by the external insulation tube, and when voltage is applied across the electrically conductive electrode and electrically conductive grounded electrode a process medium within the internal tube is converted to a physical plasma.

2. The tubular device according to claim 1, wherein the electrically conductive electrode wire and electrically conductive grounded electrode wire are arranged so that both:

a) run helically along an axis of the internal tube, or b) run parallel in an axial direction, or c) are mounted together with nonconductive fibers as a net.

3. The tubular device according to claim 1, wherein the electrically conductive electrode wire and electrically conductive grounded electrode wire are disposed in the internal dielectric tube wall and an electrically conductive screen is disposed externally to the external insulation tube in close-fitting manner around the tube.

4. The tubular device according to claim 1, comprising at least one article selected from the group consisting of dielectric bodies, dielectric liquid drops, glass beads, oil drops, and spherical particles; wherein a diameter of the article is larger than 100 μm and smaller than an inside diameter of the internal tube.

5. A therapeutic plasma jet device comprising the tubular device according to claim 1.

6. A method for generating a plasma in the tubular device of claim 1, the method comprising:

adding the process medium into the internal tube; and applying an alternating voltage, which exceeds an ignition field strength of the process medium to obtain the physical plasma.

7. The method for generating a plasma according to claim 6, wherein the alternating voltage comprises a rectangular-wave signal with an edge rate of rise of about 1 kV/ns.

8. The method for generating a plasma according to claim 6, wherein the voltage is applied in a burst mode.

9. The method for generating a plasma according to claim 6, wherein the process medium and plasma action are applied to an outer surface of the tubular device.

10. The method for generating a plasma according to claim 6, wherein the internal tube comprises:

at least one article selected from the group consisting of dielectric bodies, dielectric liquid drops, glass beads, oil drops, and spherical particles; wherein a diameter of the article is larger than 100 μm and smaller than an inside diameter of the internal tube, and, optionally, the process medium.

11. The method for generating a plasma according to claim 6, further comprising extracting the plasma generated in the tubular device by a gas stream or a virtual ground potential wherein the tubular device is a therapeutic processing instrument.

12. The method for generating a plasma according to claim 6, wherein the plasma-generation includes cleaning of the tube wall or cleaning of the process medium.

13. The method for generating a plasma according to claim 6, wherein the plasma-generation includes surface modification of the tube wall or surface modification of solid bodies added to the process medium.

14. The method for generating a plasma according to claim 6, wherein the plasma-generation further comprises coating of the tube wall or coating of solid bodies added to the process medium.

15. The method for generating a plasma according to claim 6, wherein at least one of biological decontamination, antisepsis, disinfection, and sterilization of the tube wall or of the process medium is obtained.

16. The method for generating a plasma according to claim 6, further comprising generating a jet plasma at the tube end.

17. The method for generating a plasma according to claim 16, further comprising applying the jet plasma for a therapeutic application.

* * * * *